US006022011A

United States Patent [19]

Hirose

[11] Patent Number: 6,022,011

[45] Date of Patent: Feb. 8, 2000

[54] SHEET FINISHER INCLUDING BINDING, FOLDING AND STACKING

[75] Inventor: Akira Hirose, Tokyo, Japan

[73] Assignee: Ricoh Company, Ltd., Tokyo, Japan

[21] Appl. No.: 08/961,148

[22] Filed: Oct. 30, 1997

[30] Foreign Application Priority Data

Nov. 1, 1996 [JP] Japan ..... 8-291808
Apr. 23, 1997 [JP] Japan ..... 9-106082

[51] Int. Cl.[7] ..... B41L 43/12

[52] U.S. Cl. ..... 270/37

[58] Field of Search ..... 270/58.07, 58.11, 270/58.13, 37, 32, 45, 49, 50; 399/410; 493/444, 405, 416, 417, 442

[56] References Cited

U.S. PATENT DOCUMENTS 3,632,104 1/1972 Dufour ..... 493/444
5,099,292 3/1992 Hirose .
5,108,082 4/1992 Shea et al. ..... 270/37 X
5,382,011 1/1995 Tani ..... 270/37
5,442,432 8/1995 Tani ..... 399/410
5,590,871 1/1997 Okabe et al. ..... 270/58.27
5,709,376 1/1998 Ushirogata ..... 270/58.11
5,836,576 11/1998 Ebner et al. ..... 270/58.02

FOREIGN PATENT DOCUMENTS 6-286358 10/1994 Japan .

*Primary Examiner*—Donald P. Walsh
*Assistant Examiner*—Patrick Mackey
*Attorney, Agent, or Firm*—Oblon, Spivak, McClelland, Maier & Neustadt, P.C.

[57] ABSTRACT

In a finisher for an image forming apparatus, when a staple mode is selected, sheets are sequentially stacked on a stacker while being turned over. In a corner staple mode, a stapler staples the sheets stacked on the stacker at the side facing the first page of the sheet stack. The stapled sheet stack is driven out to a first tray. In a center staple mode, after the sheet stack has been stapled, it is folded double at its center by a fold edge, then pressed by a press roller pair, and then driven out to a second tray.

8 Claims, 3 Drawing Sheets

SHEET FINISHER INCLUDING BINDING, FOLDING AND STACKING

BACKGROUND OF THE INVENTION

The present invention relates to a finisher capable of receiving copy sheets sequentially driven out of a copier, facsimile apparatus, printer or similar image forming apparatus, and finishing the sheets stacked therein. More particularly, the present invention is concerned with a finisher capable of selectively stapling a sheet stack at its center and then folding it double or simply stapling the sheet stack at its corner or edge portion.

A finisher of the type described is extensively used with an image forming apparatus. Japanese Patent Publication No. 8-28788, for example, teaches a system capable of recognizing a direction in which stapling means acts on a sheet stack, i.e., whether it acts on the front of a sheet stack or the rear of the same. The system controls, based on the recognized direction, reading means such that image data are read out of a storage in a particular order of page. With this system, it is possible to staple, without regard to the acting direction of the stapling means, a sheet stack from the first page side which is turned over often, thereby reducing damage to the recording materials.

Driving a staple into a sheet stack from the first page side, as stated above, is desirable because the opposite ends of the staple are bent at the rear of the stack and provides the stack stapled at its corner with attractive appearance. However, there is an increasing demand for a finisher capable of stapling a sheet stack at its center, particularly one capable of accommodating sheets of various sizes.

Technologies relating to the present invention are also taught in Japanese Patent Laid-Open Publication No. 6-286358.

SUMMARY OF THE INVENTION

It is therefore an object of the present invention to provide a finisher for an image forming apparatus and having a center stapling function in addition to the conventional corner stapling function, capable of finishing a sheet stack efficiently in accordance with the sheet output order of a printer, capable of dealing with sheets of various sizes, and capable of being connected to a printer in an on-line configuration.

It is another object of the present invention to provide a finisher for an image forming apparatus capable of achieving each of the above two different functions most efficiently, and allowing the operator to pick out finished sheet stacks easily and rapidly.

It is a further object of the present invention to provide a small size, high speed finisher for an image forming apparatus and having a stapling mechanism and a folding mechanism so arranged as to minimize the required displacement of a sheet stack.

In accordance with the present invention, a finisher for receiving sheets sequentially driven out of an image forming apparatus via a sheet outlet, and stapling and folding a stack of the sheets includes a stacker for sequentially stacking the sheets such that each sheet faces the rear of the previous sheet existing in the stacker. A sizing device varies the vertical and horizontal dimensions of the stacker in accordance with the size of the sheets to be stacked. A moving device is provided for moving the sheet stack. A stapler is located at least in a range in which the sheet stack is moved by the moving device, for driving a staple into the sheet stack at the side facing the sheet introduced into the finisher first. A folding device causes a fold edge to fold the sheet stack double toward the fold edge at the side facing the sheet introduced into the finisher last.

Also, in accordance with the present invention, in a finisher selectively operable in a first mode in which sheets sequentially driven out of an image forming apparatus via a sheet outlet are stacked on a stacker and then stapled at its edge portion by a stapler, or a second mode in which the sheets stacked on the stacker are stapled at its center by the stapler and then folded double by a folding device, in the first mode the stapler is located between the folding device and the edge portion of the sheets to be stapled, but closer to the edge portion of the sheets than to the folding device.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
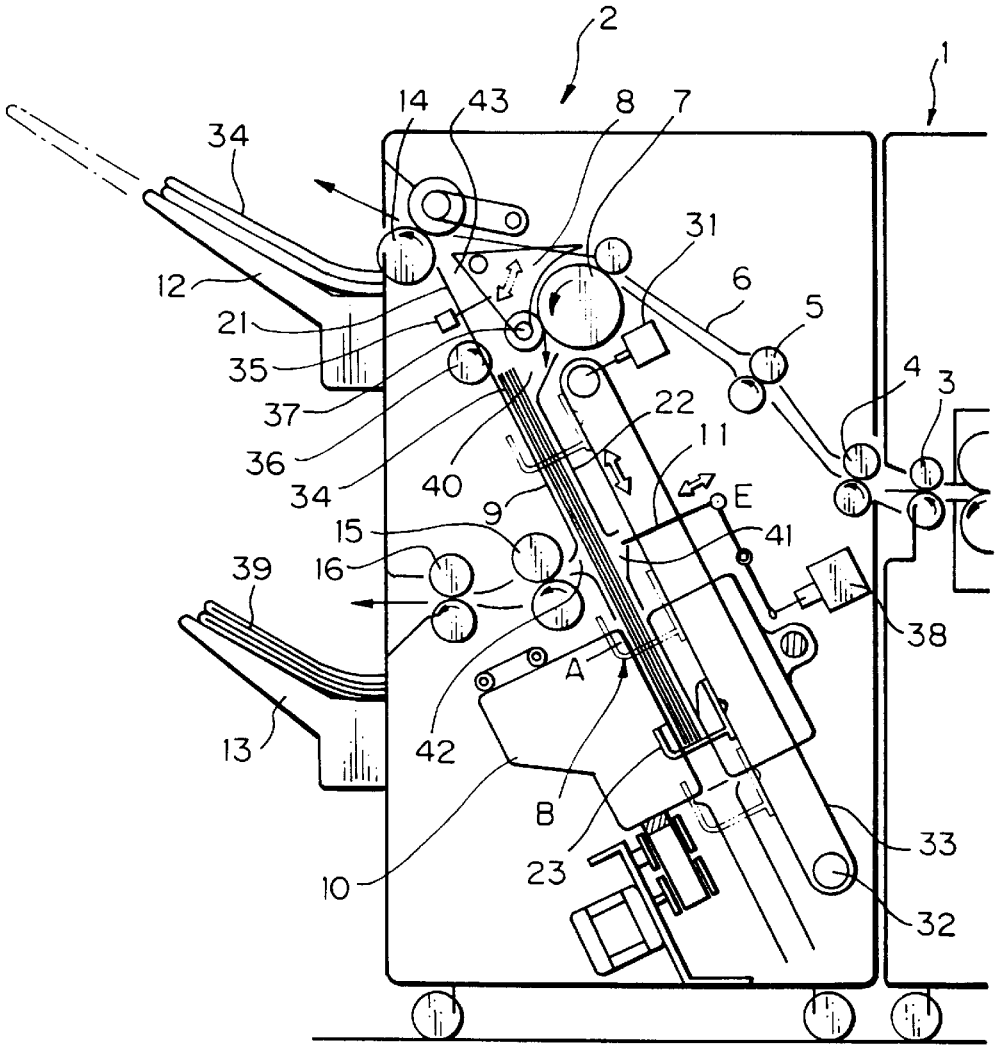
FIG. 1 shows a finisher embodying the present invention together with a part of an image forming apparatus to which it is connected.
Figure 2:
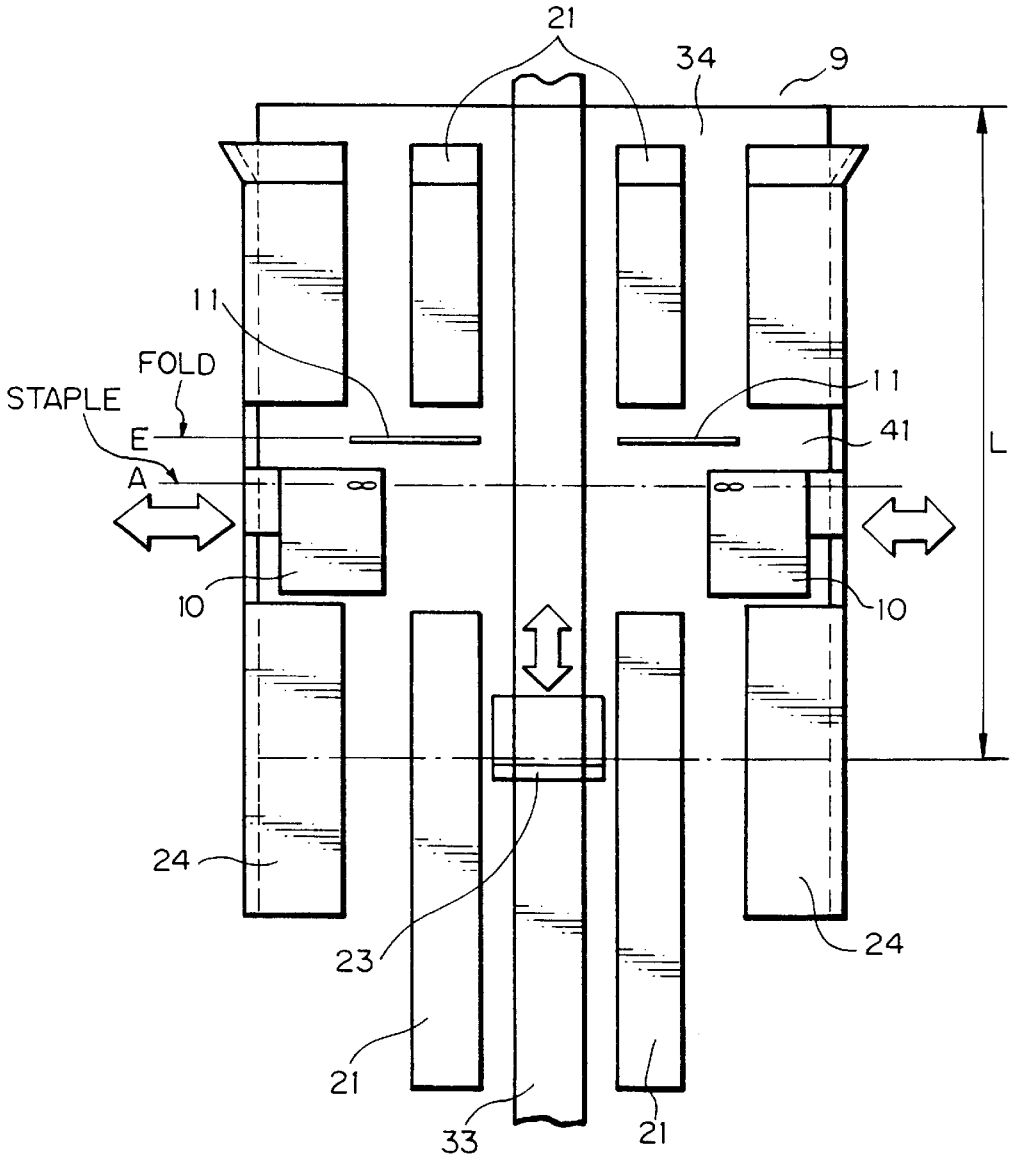
FIG. 2 is a plan view showing a specific configuration of a stacker included in the embodiment.

Referring to FIGS. 1 and 2 of the drawings, a finisher embodying the present invention is shown. In FIGS. 1 and 2, there are shown a stapling position A and a folding position E. Labeled B in FIG. 1 is the position of the corner portion of a sheet stack, i.e., the position of a stop occurring in a corner staple mode. Further, labeled L in FIG. 2 is the length of a sheet stack as measured in the direction of sheet transport.

As shown in FIG. 1, a finisher 2 is connected to the sheet outlet portion of an image forming apparatus 1. A sheet is driven out of the image forming apparatus 1 by an outlet roller pair 3 included in the apparatus. The sheet coming out of the apparatus 1 is driven into the finisher 2 by an inlet roller pair 4 located at the inlet of the finisher 2.

The finisher 2 includes, in addition to the inlet roller pair 4, a conveyor roller pair 5, a sheet transport path 6, a turn roller 7, a path selector 8, a stacker 9, a stapler 10, a fold edge 11, a first tray 12, a second tray 13, a roller pair 14 for discharging sheets to the first tray 12, a roller pair 15 for conveying sheets to the second tray 13, and an outlet roller pair 16. The stacker 9 extends downward from the upstream side toward the downstream side in the direction of sheet transport and is inclined by a predetermined amount relative to a vertical transport plane. The stapler 10 and fold edge 11 are serially arranged in the stacker 9 in the direction parallel to the direction of sheet transport. The roller pair 15 plays the role of a prepress roller pair while the outlet roller pair 16 plays the role of a final press roller pair, as will be described specifically later. The stacker 9 has an upper guide 22, a lower guide 21, a stop or moving means 23, and side guides 24 (see FIG. 2). The vertical and horizontal dimensions of the stacker 9 are variable in accordance with a sheet size. The stop 23 is disposed in the stacker 9 and extends perpendicularly to the direction of sheet transport. The rest of the construction of the finisher body 2 will be described in relation to the operation hereinafter.

In operation, a sheet driven out of the image forming apparatus 1 by the outlet roller pair 3 is introduced into the finisher 1, by the inlet roller pair 4. The sheet is conveyed to the turn roller 7 along the transport path 6 by the roller pair 15. When a staple mode for stapling and folding a sheet stack is not selected, the sheet is directly driven out to the first tray 12 by the roller pair 14 via the path selector 8 which is held in its lowered position. When the staple mode is selected, the path selector 8 is brought to its raised position. In this position, the path selector 8 steers the sheet into an arcuate gap formed between it and the turn roller 7. As a result, the sheet is stacked in the stacker 9 while being turned over. Specifically, the sheet is introduced into t h e space between the upper guide 22 and lower guide 21.

Figure 3:
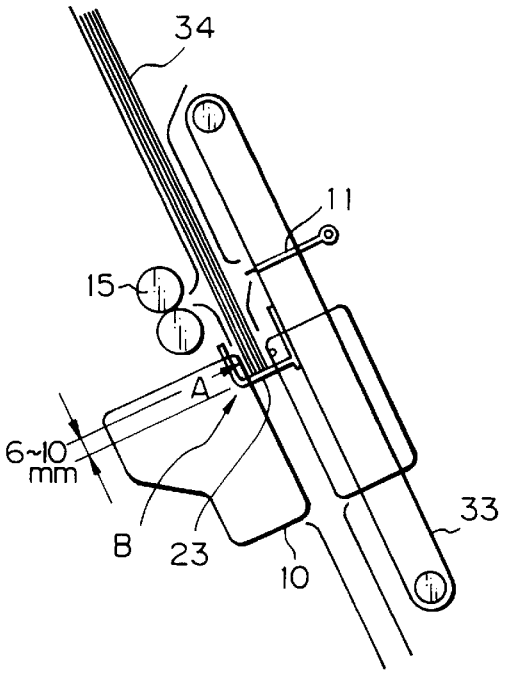
FIG. 3 shows a relation between a stapling position and the position of the edge portion of a sheet stack to hold in a corner staple mode.

A procedure for stapling a sheet stack 34 at its corner or edge portion, i.e., a corner staple mode operation is as follows. FIG. 3 shows a relation between the stapling position and the position of the edge portion of the sheet stack 34 to hold during this operation. As shown, a motor 31 is energized to drive a belt 33 via a pulley 32. As a result, the stop 23 affixed to the surface of the belt 33 is moved until the corner portion of the sheet stack 34 reaches the position B (see FIGS. 1 and 3) corresponding to the stapling position A assigned to the stapler 10. Generally, the stapling position A is spaced from the edge of the sheet stack 34 by a distance of about 6 mm to 10 mm. In this condition, the stapler 10 staples the sheet stack 34 at the side facing the sheet stacked first. Subsequently, the stop 23 is moved upward, raising the stapled sheet stack 34. When the other edge or leading edge of the sheet stack 34 moves away from a sensor 35, a press roller 37 is pressed against a drive roller 36 by the resulting output of the sensor 35. Consequently, the drive roller 36 nipping the sheet stack 34 between it and the press roller 37 conveys the sheet stack 34 upward to the roller pair 14. The roller pair 14 discharges the sheet stack 34 onto the first tray 12.

The function assigned to the stop 23 completes when the sheet stack 34 is nipped by the drive roller 36 and press roller 37. Therefore, the stop 23 is again moved downward in order to prepare for the next sheet stack.

Sheets are sequentially introduced into the stacker 9 via an opening 40 formed in the top of the stacker 9. Each sheet is stacked on the rear of the preceding sheet existing in the stacker 9. A first sheet stack outlet 43 is formed in the stacker 9 in the vicinity of the above opening 40. A second sheet stack outlet 42 is formed in the lower guide 21 within the range of movement of the sheet stack 34 at the side to which a fold formed in the sheet stack 34 by the fold edge or folding means 11 will protrude. Further, an opening 41 i s formed in the upper guide 22, as illustrated. The fold edge 11 is located to face the sheet stacked last. The fold edge 11 is thrust out toward the sheet stack 34 by a solenoid 38, so that the sheet stack 34 is thrust out via the second outlet 42 and nipped by the prepress roller pair or conveyor roller pair 15. In this manner, the sheet stack 34 is folded double toward the fold edge 11. The portion of fold edge 11 which contacts sheet stack 34 is substantially planer or in the form of a plate.

Figure 4:
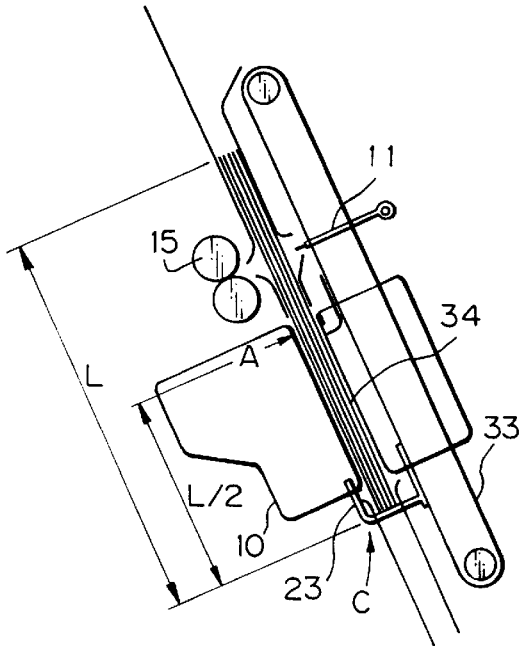
FIGS. 4 and 5 each shows a relation between the stapling position and the position of the edge portion of the sheet stack to hold in a particular step of a center staple mode.
Figure 5:
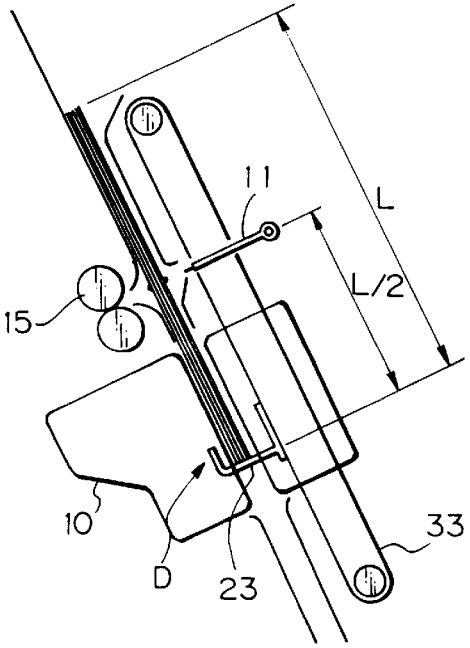

A procedure for binding the sheet stack 34 at its center, i.e., a center staple mode operation is as follows. FIG. 4 shows a relation between the stapling position and the position of the edge portion of the sheet stack 34 to hold in the first step of this procedure. FIG. 5 shows a relation between the stapling position and the edge portion of the sheet stack 34 to hold in the second step of the same procedure. As shown in FIG. 4, the motor 31 causes the stop 23 to move to a position C which is spaced from the stapling position A of the stapler 10 by a distance of L/2. As a result, the point of the sheet stack 34 corresponding to one half of the entire length L of the stack 34, as measured in the direction of sheet transport, is brought to the stapling position A. In this condition, the sheet stack 34 is stapled at its center by the stapler 10. Subsequently, as shown in FIG. 5, the stop 23 is moved to a position D such that the stapling position A coincides with the leading edge (folding point) of the fold edge 11. Then, the fold edge 11 is thrust out toward the sheet stack 34 by the solenoid 38, causing the prepress roller pair 15 to nip the sheet stack 34. The sheet stack 34 is therefore folded double toward the fold edge 11. The sheet stack 34 pressed and folded by the prepress roller pair 15 is further pressed and folded by the final press roller pair or outlet roller pair 16. Consequently, the sheet stack 34 stapled at its center and then folded double is driven out to the second tray 13. The resulting sheet stack is labeled 39 in FIG. 1. After the sheet stack 34 has been nipped by the prepress roller pair 15, the fold edge 11 is returned to its original position.

The stapler 10 is located downstream of the fold edge 11 in the direction of sheet transport in the stacker 9. Stated another way, the stapler 10 is positioned in the vicinity of the downstream edge of the sheet stack 34 to be stapled (position B shown in FIG. 3). Therefore, before stapling, the sheet stack 34 is conveyed to the downstream side of the stacker 9 until the center of the sheet stack 34 (L/2 point) moves away from the fold edge 11. Because the fold edge 11 is located at the upstream side of the stacker 9 in the direction of sheet transport, the sheet stack 34 is raised at the time of folding until the L/2 point of the stack 34 faces the fold edge 11.

In summary, it will be seen that the present invention provides a finisher for an image forming apparatus and having the following various unprecedented advantages. The finisher has a center stapling function in addition to the conventional corner stapling function. The finisher can therefore finish sheets efficiency in accordance with the sheet output order of a image printer. In addition, the finisher can deal with sheets of various sizes and can be connected to a printer in an on-line configuration. Specifically, sheets sequentially output from a printer are stacked on the finisher face down in order of page from the downstream side toward the upstream side with respect to the direction of sheet transport. A stapler included in the finisher staples a sheet stack at the side facing the first page of the stack, thereby implementing corner stapling. Because the sheet stack is movable to a desired position, the stapler can implement center stapling also. In addition, folding means included in the finisher is capable of folding the sheet stack stapled at its center double.

The finisher of the present invention includes a first and a second sheet stack outlet each being assigned to a particular function. Therefore, the finisher can achieve each function most efficiently and allows the operator to pick out finished sheet stacks easily and rapidly. That is, because all the finished sheet stacks are driven out of the finisher, the operator can pick up them easily while sorting them with respect to the finishing mode.

It has been customary with a stapling device having edge stapling and center stapling capabilities to sequentially arrange stapling means and folding means along a sheet transport path. This kind of scheme increases the overall size of the stapling device. Edge stapling should preferably be effected at a position between the lowermost end and the center of stacking means, considering the position of a sheet stack. Also, center stapling should preferably be effected at or around the center of the stacking means. In addition, folding should preferably be effected at a position above the center of the stacking means, considering the size of a sheet stack. A stacker included in the finisher of the present invention is reduced in size while satisfying such advantageous conditions, allowing the overall finisher to be reduced in size. Further, the finisher reduces the required displacement of a sheet stack so as to realize efficient stapling and short finishing time.

Although a stapling device having stapling and folding capabilities and capable of moving a sheet stack is conventional, it causes the sheet stack to move only in one direction, wasting its limited space. The finisher of the present invention has functions for finishing a sheet stack arranged serially in the direction parallel to the direction of sheet transport. Various means each being assigned to a particular operation and a sheet stack are brought into positional correspondence by moving the sheet stack. This, coupled with the fact that a sheet stack is movable in opposite directions, guarantees accurate stapling, accommodates sheets of various sizes, reduces the size of the finisher, and enhances rapid finishing operation.

A conventional stapling device has conveying members implemented as rollers and a belt, and a positioning member implemented as a stop member, i.e., different functions are allocated to different members. With this kind of stapling device, it is difficult to move a sheet stack of any desired size at a high speed and position it while maintaining the accuracy of the stack. The finisher of the present invention causes a stop not only to position a sheet stack in its lengthwise direction, but also to move the sheet stack. This makes it needless to use an exclusive moving means for moving a sheet stack to a stapling position in any one of different staple modes. Further, the finisher is capable of moving a sheets stack in opposite directions easily with high accuracy. In addition, a single member serves the above two different functions and thereby promotes the efficient use of a drive source.

The finisher of the present invention allows a sheet stack to be positioned and moved due to its own weight. Specifically, a conventional stapling device conveys a sheet stack along a substantially horizontal transport path by use of a belt or rollers then causes the stack to abut against a stop for positioning, and then staples and folds the stack. In this case, gravity does not act in the stack positioning direction at all, so that the four sides of the sheet stack must be positioned. In accordance with the present invention, sheets sequentially introduced into the stacker rest on the stop at their lower edges due to their own weight and remain there accurately. Therefore, such a sheet stack should only be positioned at its two sides perpendicular to the bottom (three sides in total). It follows that a sheet stack moved by the stop can be stapled at an accurate position in any one of the corner staple mode, center staple mode, and fold mode. Moreover, because the stacker is inclined, sheets can extend along a preselected surface and can be stacked in order of page without bending.

Various modifications will become possible for those skilled in the art after receiving the teachings of the present disclosure without departing from the scope thereof.

What is claimed is:

1. A finisher for finishing sheets received from an image forming apparatus, said finisher comprising:

a stacker provided in a sheet path and configured to sequentially stack the sheets such that each sheet faces a rear of a previous sheet existing in said stacker;

a sizer configured to vary a vertical and a horizontal dimension of said stacker in accordance with a size of the sheets to be stacked;

a sheet stack mover configured to move a stack of the sheets over a range of movement, along the sheet path;

a stapler located at least in a range in which the sheet stack is moved by said sheet stack mover, configured for driving a staple into the sheet stack at a side facing the sheet introduced into said finisher first;

a folder including a fold member, said folder configured to drive said fold member so as to fold the sheet stack double toward said fold member at a side facing the sheet introduced into said finisher last, and thereby eject a fold line of the stack transversely from said sheet path;

an opening located above said stacker, configured to receive sheets into said stacker such that each sheet faces a rear of a previous sheet existing in said stacker; and a first sheet stack outlet communicating with said stacker via a first discharge path, said first sheet stack outlet defining an aperture through which unfolded sheets are discharged from an interior of said finisher, said first sheet stack outlet adjoining said opening, and a second sheet stack outlet communicating with said stacker via a second discharge path, said second discharge path located in said range of movement of the sheets at a side to which the fold line of the sheet stack formed by said folder, is ejected by said folder, said second sheet stack outlet defining an aperture through which folded sheets are discharged from an interior of said finisher.

2. A finisher as claimed in claim 1, selectively operable in at least one of a first mode in which sheets sequentially driven out of an image forming apparatus via a sheet outlet, are stacked on said stacker and then stapled at an edge portion thereof by stapler, and a second mode in which the sheets stacked on said stacker are stapled at a center thereof by said stapler and then folded double by said folder;

wherein in said first mode, said stapler is located between said folder and the edge portion of the sheets to be stapled, but closer to the edge portion of the sheets than to said folder.

3. A finisher as claimed in claim 2, wherein said stacker extends downward from an upstream side to a downstream side with respect to a direction of sheet transport and is inclined by a preselected amount relative to a vertical sheet transport plane.

4. A finisher as claimed in claim 2, wherein said stapler and said folder are serially arranged in said stacker in a direction parallel to a direction of sheet transport, and wherein stapling a sheet stack at the edge portion, stapling the sheet stack at the center and folding the sheet stack each is implemented by a particular reversible movement of the sheet stack parallel to a direction in which the sheets are conveyed in said stacker.

5. A finisher as claimed in claim 4, wherein said stacker extends downward from an upstream side to a downstream side with respect to a direction of sheet transport and is inclined by a preselected amount relative to a vertical sheet transport plane.

6. A finisher as claimed in claim 4, wherein positioning extends in said stacker means perpendicularly to the direction of sheet transport, for positioning the sheet stack.

7. A finisher as claimed in claim 6, wherein said stacker extends downward from an upstream side to a downstream side with respect to a direction of sheet transport and is inclined by a preselected amount relative to a vertical sheet transport plane.

8. A finisher for finishing sheets received from an image forming apparatus, said finisher comprising:

a stacker provided along a sheet path and configured to sequentially stack the sheets such that each sheet faces a rear of a previous sheet existing in said stacker;

a sizer configured to vary a vertical and a horizontal dimension of said stacker in accordance with a size of the sheets to be stacked;

a sheet stack mover configured to move a stack of the sheets along the sheet path;

a stapler located at least in a range in which the sheet stack is moved by said sheet stack mover, configured for driving a staple into the sheet stack at a side facing the sheet introduced into said finisher first;

a folder including a fold edge for folding the sheet stack double toward said fold edge at a side facing the sheet introduced into said finisher last, said folder configured to drive said fold edge in a direction transverse to the sheet path such that the sheets to be folded are folded along a fold line and the fold line is ejected transversely from the sheet path;

an opening located above said stacker for introducing the sheets into said stacker such that each sheet faces a rear of a previous sheet existing in said stacker;

a first sheet stack outlet adjoining said opening, said first sheet stack outlet communicating with said stacker via a first discharge path, said first sheet stack outlet defining an aperture through which unfolded sheets are discharged from an interior of said finisher, and a second sheet stack outlet communicating with said stacker via a second discharge path, said second discharge path located in said range of movement of the sheets, at a side to which the fold line of the sheet stack formed by said folder is ejected, said second sheet stack outlet defining an aperture through which folded sheets are discharged from an interior of said finisher.

* * * * *